US005305718A

United States Patent [19]

Müller

[11] Patent Number: 5,305,718

[45] Date of Patent: Apr. 26, 1994

[54] HYDRAULIC CONTROL DEVICE

[75] Inventor: Martin Müller, Moeglingen, Fed. Rep. of Germany

[73] Assignee: Robert Bosch GmbH, Stuttgart, Fed. Rep. of Germany

[21] Appl. No.: 64,163

[22] PCT Filed: Sep. 4, 1992

[86] PCT No.: PCT/DE92/00750

§ 371 Date: May 19, 1993

§ 102(e) Date: May 19, 1993

[87] PCT Pub. No.: WO93/08380

PCT Pub. Date: Apr. 29, 1993

[30] Foreign Application Priority Data

Oct. 26, 1991 [DE] Fed. Rep. of Germany ..... 4135377

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/1, 2, 160; 74/568 R

[56] References Cited

U.S. PATENT DOCUMENTS 4,787,345 11/1988 Thoma ..... 123/90.17
5,012,773 5/1991 Akasaka et al. ..... 123/90.17
5,189,999 3/1993 Thoma ..... 123/90.17
5,209,194 5/1993 Adachi et al. ..... 123/90.17
5,247,914 9/1993 Imai et al. ..... 123/90.17

FOREIGN PATENT DOCUMENTS 3247916 6/1984 Fed. Rep. of Germany .
3929621 3/1991 Fed. Rep. of Germany .

*Primary Examiner*—Raymond A. Nelli
*Assistant Examiner*—Weilun Lo
*Attorney, Agent, or Firm*—Michael J. Striker

[57] ABSTRACT

The hydraulic control device for rotating the camshaft of an internal combustion engine has a couple member constructed as a piston (25) connected with the sprocket wheel of the camshaft via a spiral toothing and with the camshaft via a straight toothing. A hydraulic body is mounted on at the camshaft and receives a radial piston pump which delivers the pressure medium required for the displacement of the piston. The pressure space is closed by a controllable pressure limiting valve. An electromagnetic valve controls a pressure medium flow to the piston bores of the radial piston pump and the pressure medium is delivered by an external pump. The sprocket wheel and camshaft are rotated relative to one another by the displacement of the piston.

12 Claims, 1 Drawing Sheet 39
45
43
55
47
53
40
50
49
51
52
38
41
56
57
58
60
44
46
37
11
35

II
II
39
11
10
29
28
27
23
30
31
34
35
33
32
73
72
12
71
15
63
65
64
14
62
75
76
82
91
85
86
84
83
87
92
89
93
88
94
79
25
78
77
80
24
22
68
69
20
21
10A
16
17
13
90
66
96
67

HYDRAULIC CONTROL DEVICE

BACKGROUND OF THE INVENTION

The present invention relates to a hydraulic control device for rotating a camshaft of an internal combustion engine.

More particularly, it relates to a hydraulic control device for rotating a camshaft of an internal combustion engine, which has a longitudinally displaceable couple member acted upon by pressure and having a first outer toothing engaging with an inner toothing of a sprocket wheel driven by the internal combustion engine and a second toothing engaging a toothing of the camshaft, wherein the pressure medium delivered by a pump is directed via an electromagnetic valve.

Hydraulic control devices of the above mentioned general type are known in the art. One of such hydraulic control devices is disclosed in the German reference DE-OS 32 47 916.

In such a known control device in particular the pump and the electromagnetic valve are arranged externally, which is relatively complicated, requires a large amount of space, and is very cumbersome in view of the necessary pressure medium connections.

SUMMARY OF THE INVENTION

Accordingly, it is an object of the present invention to provide a hydraulic control device of the above mentioned general type, which avoids the disadvantages of the prior art.

In keeping with these objects and with others which will become apparent hereinafter, one feature of the present invention resides, briefly stated, in a hydraulic control device in which a hydraulic body is flanged on at a widened end portion of the camshaft on which the sprocket wheel also sits, a radial piston pump with a plurality of pistons slides in approximately radially extending piston bores in the hydraulic body, the spherical caps of the pistons contact an inner ring of a ball bearing which is arranged in a stationary housing eccentrically relative to the axis of the camshaft, an outlet valve is connected to a pressure space of every piston bore and its outlet opens into the pressure space of the longitudinal bore hole which receives a single-action piston and extends in the hydraulic body, the pressure spaces closed by the valve housing of a pressure limiting valve controlling the valve housing, and the inlet side of the piston bores are fed by a pump, wherein the magnetic valve which controls the feed flow is arranged between the pump and the piston bores.

When the hydraulic control device is designed in accordance with the present invention, it has the advantage over the prior art of a very compact construction and a very simple installation in the internal combustion engine or its engine compartment. It operates with high precision and is also relatively simple to assemble.

In accordance with another feature of the present invention the pressure limiting valve at the pressure space has a diaphragm which is acted upon by pressure and controls a valve seat constructed at the plate.

The camshaft, the sprocket wheel and the hydraulic body can be connected by screws which penetrate through sleeves arranged in the sprocket wheel in longitudinal slots, and there are pressure medium connections in the screws from the piston bores via the electromagnetic valve to the pump.

The electromagnetic valve can be arranged in a bearing member supporting the camshaft and can receive a tappet connected with the armature so as to actuate the valve member and simultaneously control a connection from the pump to the outlet of the electromagnetic valve.

The sensor ring can be arranged on the rotating hydraulic body, a throttle can be provided in the inlet duct to the piston bores. The toothing pairs can be formed as a spiral toothing and a spur toothing, wherein the spiral toothing can be formed at the inner circumference of the sprocket wheel and the outer circumference of a widened portion of the couple member.

Finally, a restoring force can act in form of a pressure spring on the piston or can be applied by the spiral toothing acting on the piston and having an angle of approximately 30°–45°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
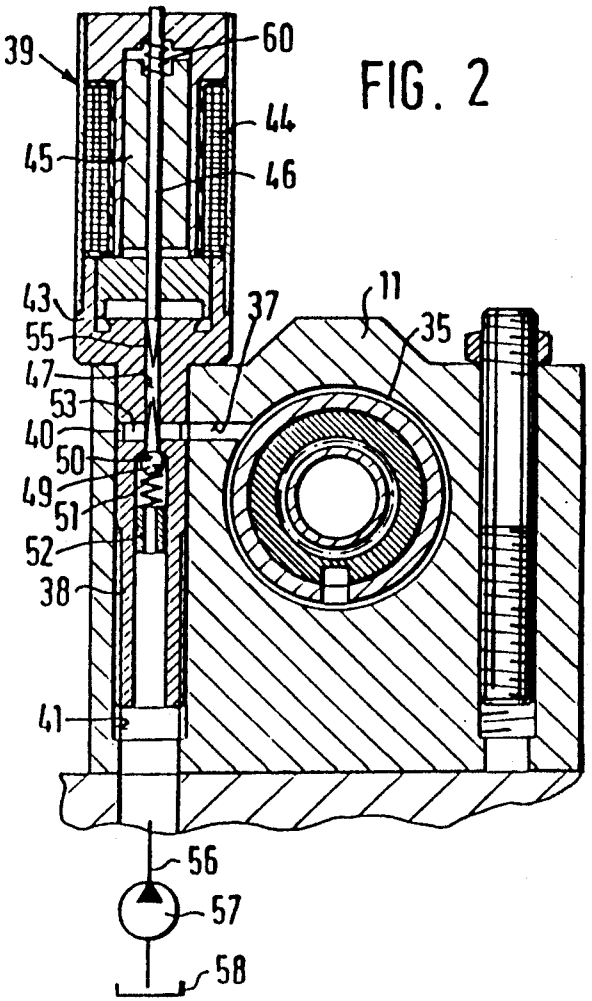
FIG. 2 shows a section along II—II according to FIG. 1.
Figure 1:
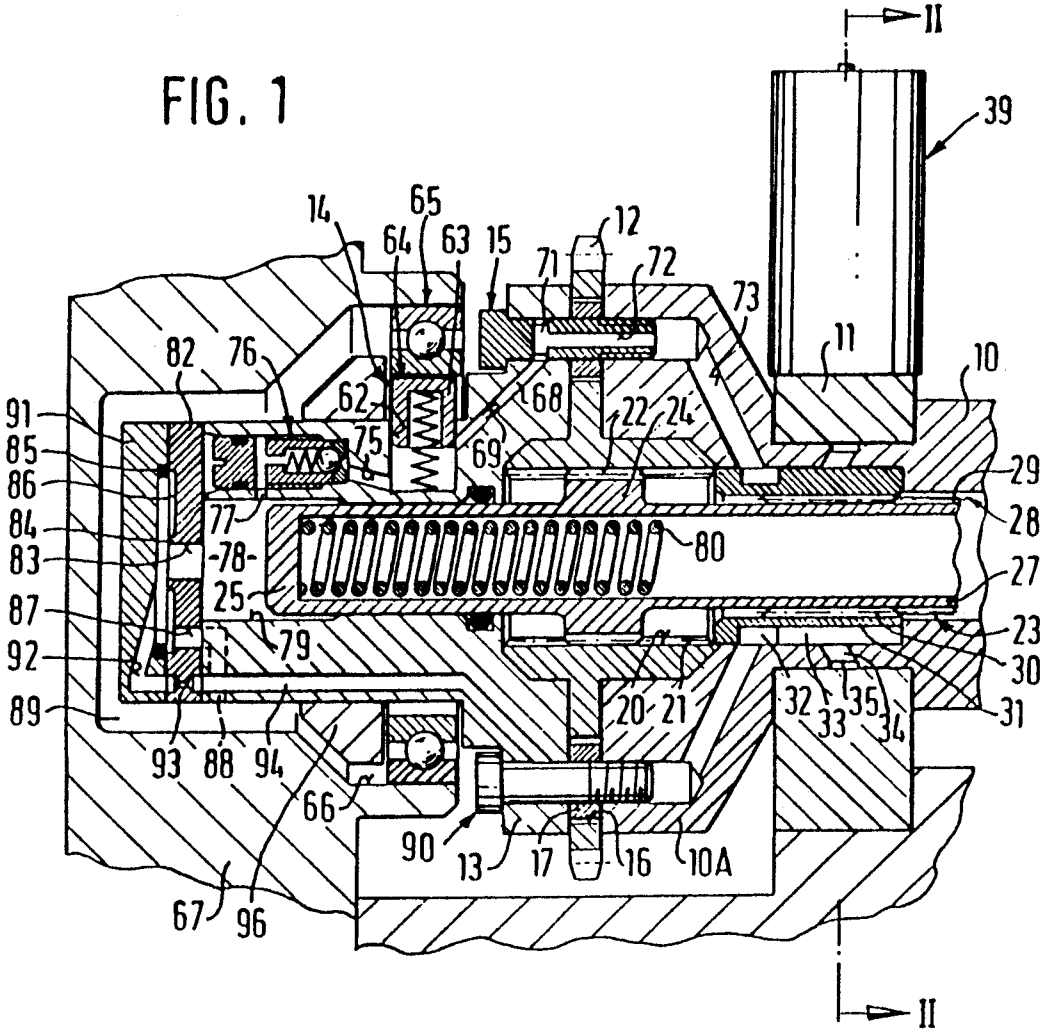
FIG. 1 shows a longitudinal section through a hydraulic control device for rotating the camshaft of an internal combustion engine.

In FIG. 1 the camshaft which is supported in a camshaft bearing block 11 is designated by 10. The sprocket wheel 12 for driving the camshaft 10 is arranged at the widened end face 10A of the camshaft 10. A hydraulic body 13 which receives a radial piston pump 14, which will be discussed below, is located next to this sprocket wheel 12. These parts, namely the hydraulic body 13, sprocket wheel 12 and end part 10A of the camshaft 10, are connected with one another by a plurality of screws 15. The number of these screws, with one exception, corresponds to the number of pistons of the radial piston pump. Slots 16 are constructed in the sprocket wheel so that the camshaft 10 can rotate relative to the sprocket wheel 12 for the purpose of adjusting the inlet and outlet valves of the internal combustion engine. Sleeves 17 which are penetrated by the screws 15 are arranged in these slots 16. The slots 16 are curved and the sleeves 17 lie therein with a certain amount of play. The screws 15 help to supply the radial piston pump with pressure medium, but this will be discussed in the following.

The chain wheel 12 has a central bore hole 20 at which a helical or spiral toothing 21 is constructed. The latter meshes with the spiral toothing 22 at the outer circumference of a widened portion 24 of a couple member 23 which simultaneously forms a piston 25 which can be acted upon by pressure. The couple member is an elongated sleeve from which a cylindrical continuation 27 extends deep into a central longitudinal bore hole 28 of the camshaft. A spur or straight toothing 29 is formed at the continuation 27 at the height of the camshaft bearing 11 and engages with an identical toothing 30 at the inner circumference of a sleeve 31 which is arranged in the longitudinal bore hole 28 so as to be fixed with respect to relative rotation. An annular groove 32 is situated at the outer circumference of the sleeve 31. A longitudinal groove 33 proceeds from the outer circumference of the annular groove 32 and a transverse bore hole 34 which penetrates the camshaft 10 opens into the longitudinal groove 33. The transverse bore hole 34 is connected in turn with an annular groove 35 at the outer circumference of the camshaft 10 and lies within the camshaft bearing 11. A bore hole 37 which penetrates the camshaft bearing 11 opens into the annular groove and leads to the shaft 38 of a solenoid valve or electromagnetic valve 39 where it opens out at an annular groove 40. The shaft 38 is inserted into a bore hole 41 of the camshaft bearing 11. The shaft 38 is integral with a pot-shaped housing 43 of the electromagnetic valve 39 which, for the rest, in a conventional manner, has a coil 44 and a cylindrical magneto armature 45 in which a tappet 46 is securely arranged. The tappet 46 dips into a continuous longitudinal bore hole 47 in the shaft 38 and cooperates with a valve body 49 which rests against a valve seat 50 constructed at the longitudinal bore hole 47, specifically due to the force of a pressure spring 51 which is supported at a sleeve 52 in the longitudinal bore hole. A transverse bore hole 53 traversing the shaft 38 penetrates into the annular groove 40. The tappet has a square 55 at its end facing the valve body. A line 56 leading to a pump 57 is connected to the bore hole 41 receiving the electromagnetic valve 39. The pump 57 sucks pressure medium from an oil reservoir 58 in the internal combustion engine. It should be noted that a pressure spring 60 acts on the armature 45 of the electromagnet against the force of the spring 51. Voltage is applied to the electromagnetic valve 39 at a frequency of approximately 100 Hz with a variable duty factor. At a low duty factor the electromagnetic valve is opened only briefly. The opening cross section averaged over time increases with the duty factor.

The radial piston pump 14 has a plurality of radially extending bore holes 62 which are constructed in the hydraulic body. Pistons 63 whose spherical caps contact the inner ring 64 of a ball bearing 65 which is eccentrically arranged in the bore hole 66 of a part of the housing 67 of the internal combustion engine slide in these bore holes 62. A diagonal bore hole 68 which is constructed in the hydraulic body penetrates into the central portion of each piston bore 62, a suction throttle 69 being arranged in this diagonal bore hole 68. The diagonal bore hole 68 opens out at a transverse bore hole 71 in the screw 15, a longitudinal bore hole 72 opening into this transverse bore hole. The latter 72 is connected to a diagonal bore hole 73 in the head part 10A of the camshaft and opens into the annular groove 32 of the sleeve 31. It will be discerned from this that the piston bores 62 communicate with the electromagnetic valve 39 and, via the latter, with the pump 57.

A bore hole 75 runs from the base of every piston bore 62 to an outlet valve 76 for the radial piston pump, which is not discussed in more detail as it involves a conventional construction. A small bore hole 77 is arranged at the output of the outlet valve and communicates with a pressure space 78 which forms the end portion of a central bore hole 79 in the hydraulic body 13. The piston 25 projects into the pressure space 78. The piston 25 is acted upon by a pressure spring 80 arranged in its hollow interior. The pressure space 78 is closed by a plate 82 having a central continuous bore hole 83, an annular valve seat 84 for a valve diaphragm 85 being formed at its rear side. A bore hole 87 penetrates the plate 82 proceeding from an annular space 86 between the diaphragm 85 and the valve seat 84. This bore hole connects with a duct 88 in the hydraulic body, which duct 88 opens into an annular space 89 located outside the hydraulic body. The diaphragm 85 is located in a cover 91 closing the plate 84. A duct 92 formed in the cover 91 and connected with a throttle bore 93 in the plate 82 proceeds from the rear side of the diaphragm. This throttle bore is connected in turn with a duct 94 in the hydraulic body which leads to a screw 90 as was described above. This screw is arranged in addition to the other screws which are connected with the piston bores.

The control device operates as follows: when the electromagnetic valve 39 is controlled at a low duty factor, only a small amount of pressure medium flows via the valve 49 into the bore hole 37 and the annular space 35. The valve body 49 is lifted from the seat only briefly for the pulse period. The pressure medium flows into the bore hole 68 via the duct 34, longitudinal groove 33, annular groove 32, diagonal bore hole 73, and bore holes 71, 72 in the screw 15. When the hydraulic body 13 rotates, the pistons 63 of the radial piston pump 14 deliver only small amounts of pressure medium into the pressure space 78 via the outlet valve 76 and the bore hole 77. The diaphragm 85 is likewise pressed on the valve seat 84 with only slight force. The pressure medium required for this likewise flows via the bore holes in the screw 90, the duct 94, the throttle 93 and the duct 92 behind the diaphragm 85. However, the force of the spring 80 acting on the piston 25 is greater than the pressure force of the pressure medium in the space 78 so that the diaphragm 85 which contacts the valve seat with a slight force is lifted and the pressure medium can flow off via the annular space 86 and duct 87, 88. The pressure spring 80 now displaces the couple member in the direction of the plate 82. A relative rotation of the sprocket wheel 12 relative to the camshaft 10 is now effected by the toothing 29, 30 and 21, 22 at the collar 24 and the sleeve 31, respectively. The camshaft now occupies a first position.

When the electromagnetic valve 39 is supplied with current at a high duty factor with a corresponding opening of same averaged over time, a greater amount of pressure medium arrives in the piston bores 62 so that the radial piston pump 14 delivers a proportionately greater amount. This also substantially increases the pressure in the pressure space 78 and the diaphragm 85 is also pressed onto the valve seat 84 with greater force via the duct connection described above so that pressure medium can no longer flow out of the pressure space 78. The piston 25 is now moved against the force of the spring 80 and the couple member 23 provided with the above-mentioned toothing now rotates the camshaft 10 relative to the sprocket wheel 12 in an opposite direction as before, so that the inlet and outlet valves of the internal combustion engine occupy a second position. As a result of corresponding partial application of current to the electromagnetic valve 39, the pressure force on the piston 25 can be maintained in equilibrium with the force of the spring 80 and the axial force due to the spiral toothing and a determined center position or any other desired position is achieved.

A sensor ring 96 is also securely arranged on the hydraulic body 13 and rotates with it. It has a toothing, not shown, at the diagonal in a working connection with a suitable sensor. The electromagnetic valve 39 is controlled by the sensor and an electronic device which is not shown in the drawing.

It will be understood that each of the elements described above, or two or more together, may also find a useful application in other types of constructions differing from the types described above.

While the invention has been illustrated and described as embodied in a hydraulic control device, it is not intended to be limited to the details shown, since various modifications and structural changes may be made without departing in any way from the spirit of the present invention.

Without further analysis, the foregoing will so fully reveal the gist of the present inveniton that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hydraulic control device for rotating a camshaft of an internal combustion engine, comprising a sprocket wheel which is driven by an internal combustion engine and having an inner circumference provided with a toothing; a longitudinally displaceable couple member which is acted upon by a pressure and having a first toothing provided at a first location of its outer circumference and engaging with said toothing at said inner circumference of said sprocket wheel and also having a second toothing provided at an other location of its outer circumference and engaging with a toothing of a camshaft, so as to form two toothing pairs, one of said toothing pairs being formed as a spiral toothing while another of said toothing pairs being formed as a straight toothing; a single acting piston which is acted upon by a pressure medium against a mechanical force and is arranged at said couple member; a pump and an electromagnetic valve arranged so that a pressure medium is delivered by said pump and directed via said electromagnetic valve for application of pressure on said piston, said sprocket wheel being rotated relative to the camshaft by a displacement of said couple member; a hydraulic body mountable at a widened end portion of the camshaft on which said sprocket wheel also sits and having substantially radially extending piston bores, said hydraulic body having a longitudinal bore hole a radial piston pump having a plurality of pistons sliding in said piston bores of said hydraulic body; a ball bearing arranged eccentrically relative to an axis of the camshaft and having an inner ring contacted by said pistons; an outlet valve connected to a pressure space of each of said piston bores and having an outlet, said single acting single-action piston being received in said longitudinal bore hole of said hydraulic body, said outlet of said outlet valve opening into a pressure space of said longitudinal bore hole; a pressure limiting valve having a valve housing and controlling the pressure space of said longitudinal bore hole, said valve housing closing said pressure space, said pump feeding inlet sides of said piston bores, and said electromagnetic valve controlling a feed flow and being arranged between said pump and said piston bores.

2. A hydraulic control device as defined in claim 1, wherein said pistons have spherical caps which contact said inner ring of said ball bearing; and further comprising a stationary housing in which said ball bearing is arranged.

3. A hydraulic control device as defined in claim 1, wherein said pressure limiting valve has a plate, a valve seat formed at said plate, and a diaphragm which is acted upon by pressure and controlling said valve seat.

4. A hydraulic control device as defined in claim 1, wherein said sprocket wheel has longitudinal slots and sleeves arranged in said longitudinal slots; and further comprising means for connecting said camshaft, said sprocket wheel and said hydraulic body and including screws which penetrate through said sleeves.

5. A hydraulic control device as defined in claim 4, and further comprising pressure-medium connections arranged in said screws and extending from said piston bores via said electromagnetic valve to said pump.

6. A hydraulic control device as defined in claim 1, and further comprising a bearing member arranged to support the camshaft, said electromagnetic valve having a valve member, an armature, and a tappet which is received in said bearing member, connected with said armature and actuates said valve member, said tappet simultaneously controlling a connection from said pump to an outlet of said electromagnetic valve.

7. A hydraulic control device as defined in claim 1, and further comprising a sensor ring arranged on said hydraulic body.

8. A hydraulic control device as defined in claim 1, and further comprising means forming an inlet duct to said piston bores; and a throttle arranged in said inlet duct.

9. A hydraulic control device as defined in claim 1, wherein said spiral toothing ia formed at the inner circumference of the sprocket wheel and at the outer circumference of a widened portion of said couple member.

10. A hydraulic control device as defined in claim 1, and further comprising a pressure spring providing a restoring force which acts on said piston.

11. A hydraulic control device as defined in claim 1, wherein said spiral toothing is arranged so that it applies a restoring force acting on said piston.

12. A hydraulic control device as defined in claim 11, wherein said spiral toothing has an angle of substantially 30°–45°.

* * * * *